US008633818B2

(12) United States Patent
Anson et al.

(10) Patent No.: US 8,633,818 B2
(45) Date of Patent: Jan. 21, 2014

(54) MOBILE AND AUTOMATED EMERGENCY SERVICE PROVIDER CONTACT SYSTEM

(75) Inventors: Douglas M. Anson, Dripping Springs, TX (US); James W. Clardy, Austin, TX (US); Thomas Alexander Shows, Leander, TX (US)

(73) Assignee: Dell Products L.P., Round Rock, TX (US)

( * ) Notice: Subject to any disclaimer, the term of this patent is extended or adjusted under 35 U.S.C. 154(b) by 232 days.

(21) Appl. No.: 12/968,937

(22) Filed: Dec. 15, 2010

(65) Prior Publication Data

US 2012/0154145 A1 Jun. 21, 2012

(51) Int. Cl.
*G08B 1/08* (2006.01)

(52) U.S. Cl.
USPC ..... 340/539.13; 340/425.5; 379/188

(58) Field of Classification Search
USPC ..... 340/539.1, 539.13, 539.14, 539.12, 340/539.15, 539.19, 539.18, 539.22, 573.1, 340/425.25; 702/188; 455/456.1, 456.3; 379/188
See application file for complete search history.

(56) References Cited

U.S. PATENT DOCUMENTS

| | | | | |
|---|---|---|---|---|
| 5,724,983 | A * | 3/1998 | Selker et al. | 600/301 |
| 6,433,690 | B2 * | 8/2002 | Petelenz et al. | 340/573.1 |
| 7,212,111 | B2 * | 5/2007 | Tupler et al. | 340/539.18 |
| 7,961,109 | B2 * | 6/2011 | Jang et al. | 340/573.1 |
| 8,131,566 | B2 * | 3/2012 | Dicks et al. | 705/2 |
| 8,217,795 | B2 * | 7/2012 | Carlton-Foss | 340/573.1 |
| 2003/0149526 | A1 * | 8/2003 | Zhou et al. | 701/213 |
| 2008/0133277 | A1 * | 6/2008 | Jang et al. | 705/3 |
| 2009/0137921 | A1 * | 5/2009 | Kramer et al. | 600/544 |
| 2011/0144542 | A1 * | 6/2011 | Jin et al. | 600/595 |
| 2011/0224507 | A1 * | 9/2011 | Banet et al. | 600/301 |
| 2012/0095722 | A1 * | 4/2012 | Ten Kate | 702/141 |
| 2012/0096722 | A1 * | 4/2012 | Howell et al. | 30/531 |

* cited by examiner

*Primary Examiner* — George Bugg
*Assistant Examiner* — Edny Labbees
(74) *Attorney, Agent, or Firm* — Haynes and Boone, LLP

(57) ABSTRACT

An emergency service provider contact system includes a portable chassis. A processor is housed in the portable chassis. A storage, a communications module, at least one sensor, and a display are coupled to the processor and housed in the portable chassis. A non-transitory, computer-readable medium is housed in the portable chassis, coupled to the processor, and includes instructions that, when executed by the processor, cause the processor to monitor the at least one sensor and, in response to detecting an alert event through the at least one sensor, search the storage using the alert event to retrieve contact information for at least one emergency service provider that is associated with the alert event, and contact the emergency service provider through the communications module using the contact information.

20 Claims, 5 Drawing Sheets

MOBILE AND AUTOMATED EMERGENCY SERVICE PROVIDER CONTACT SYSTEM

BACKGROUND

The present disclosure relates generally to information handling systems (IHSs), and more particularly to a mobile IHS with an automated emergency service provider contact system.

As the value and use of information continues to increase, individuals and businesses seek additional ways to process and store information. One option is an information handling system (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

Some IHSs are considered 'portable' or 'mobile' IHSs (e.g., phones, notebook computers, tablet computers, and a variety of other mobile/portable IHSs known in the art) because their size and weight allow their user to carry them around virtually anywhere. Such IHSs typically provide communication capabilities for their user, and in the case of, for example, phone IHSs, may allow a user to contact an emergency service provider (e.g., by calling an emergency service provider contact number) to request emergency services in the event the user it presented with an emergency. However, IHS users may find themselves in situations where they need emergency services but are unable to use the IHS to contact an emergency service provider. For example, an IHS user may be presented with an emergency that renders the user unconscious, paralyzed, or otherwise unable to operate the IHS to contact an emergency service provider.

Accordingly, it would be desirable to provide an improved emergency service provider contact system.

SUMMARY

According to one embodiment, an emergency service provider contact system includes a portable chassis, a processor housed in the portable chassis, a storage housed in the portable chassis and coupled to the processor, a communications module housed in the portable chassis and coupled to the processor, at least one sensor housed in the portable chassis and coupled to the processor, a display housed in the portable chassis and coupled to the processor, and a non-transitory, computer-readable medium housed in the portable chassis and coupled to the processor. The non-transitory, computer-readable medium includes instructions that, when executed by the processor, cause the processor to monitor the at least one sensor and, in response to detecting an alert event through the at least one sensor, search the storage using the alert event to retrieve contact information for at least one emergency service provider that is associated with the alert event, and contact the emergency service provider through the communications module using the contact information.

DETAILED DESCRIPTION

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a display device or monitor, a network server or storage device, a switch router or other network communication device, or any other suitable device and may vary in size, shape, performance, functionality, and price. The IHS may include memory, one or more processing resources such as a central processing unit (CPU) or hardware or software control logic. Additional components of the IHS may include one or more storage devices, one or more communications ports for communicating with external devices as well as various input and output (I/O) devices, such as a keyboard, a mouse, and a video display. The IHS may also include one or more buses operable to transmit communications between the various hardware components.

Figure 1:
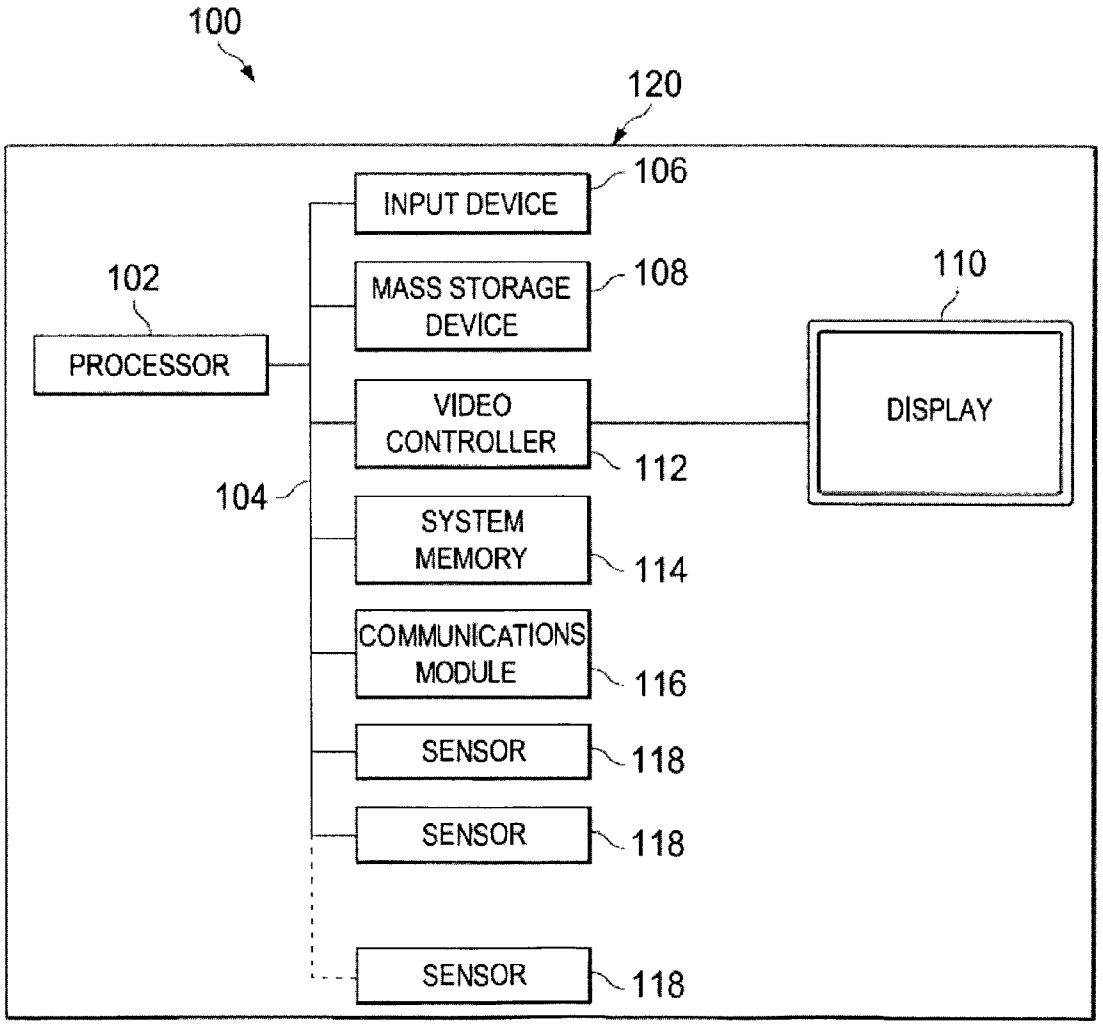
FIG. 1 is a schematic view illustrating an embodiment of an information handling system.

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. In an embodiment, the system memory 114, storage 108, and/or other components of the IHS 100 provide a non-transitory computer-readable medium that is operable to store instruction for execution by the processor 102 to perform a variety of methods, as will be explained in further details below. Examples of system memory may include random access memory (RAM) devices such as dynamic RAM (DRAM), synchronous DRAM (SDRAM), solid state memory devices, and/or a variety of other memory devices known in the art. A communications module 116 is coupled to the processor 102 to enable communication between the IHS 100 and other IHSs over a variety of mediums such as, for example, wired networks, wireless networks, and/or a variety of other communication mediums known in the art. One or more sensors 118 a coupled to the processor 100 and may include, for example, one or more accelerometers, global positioning system (GPS) modules or other location sensing technologies (e.g., triangulation using wfi, cell, radio, television, and/or other technologies), magnetometers, gyros (single and multi-axis), temperature sensors, electromagnetic sensors, skin conductivity sensors, compasses, chemical sensors, Geiger counters, proximity sensors, noise sensors (e.g., microphones), pressure sensors, humidity sensors, allergen sensors, air pollution sensors, subsonic and/or ultrasonic field sensors, light sensors, and/or a variety of other sensors known in the art. In an embodiment, a chassis 120 houses some or all of the components of IHS 100. It should be understood that other buses and intermediate circuits can be deployed between the components described above and processor 102 to facilitate interconnection between the components and the processor 102.

Figure 2:
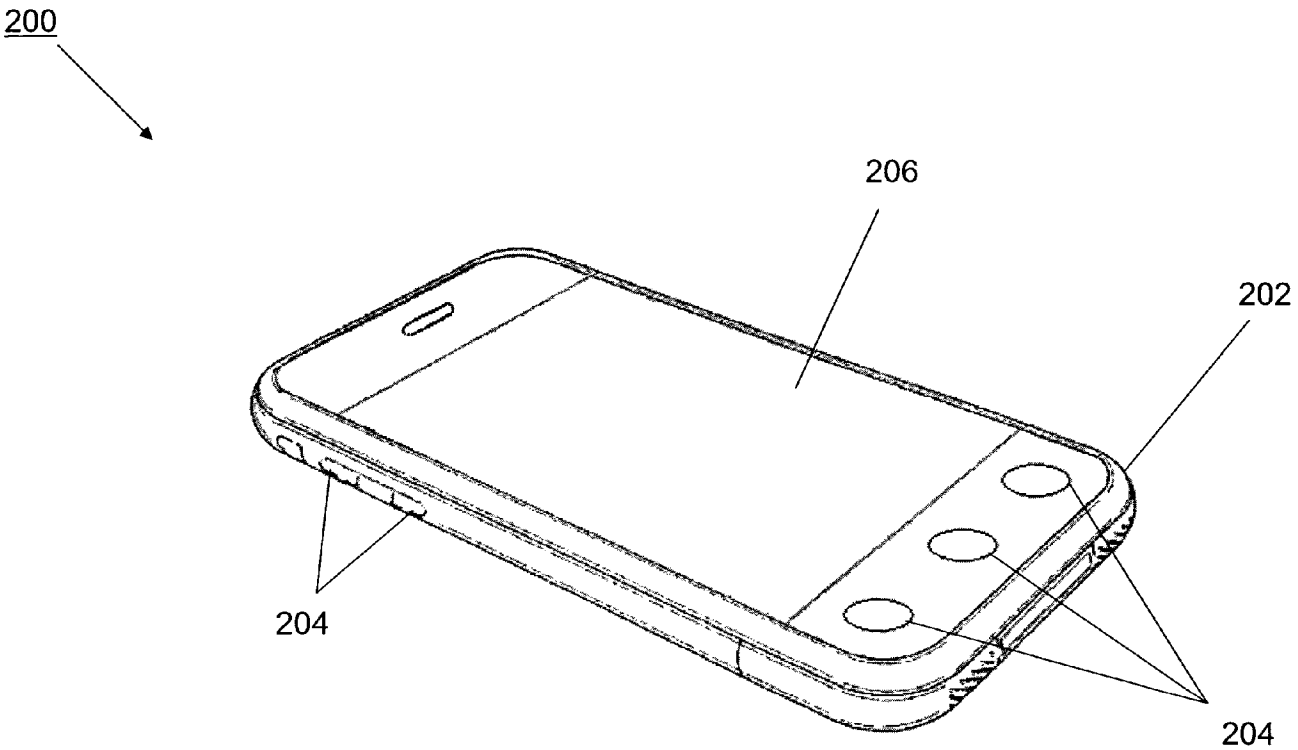
FIG. 2 is a perspective view illustrating an embodiment of an information handling system.

Referring now to FIG. 2, an embodiment of a portable or mobile IHS 200, which may be the IHS 100 described above with reference to FIG. 1, is illustrated. The IHS 200 includes a portable chassis 202, which may be the chassis 120. The portable chassis 202 also includes a plurality of input devices 204, which may be the input device 106, and a display 206, which may be the display 110 and/or the input device 106 (e.g., a touch screen display.) The portable chassis 202 may house some or all of the components of the IHS 100, discussed above. One of skill in the art will recognize that the embodiment of the IHS 200 illustrated in FIG. 2 is a phone that may be carried with or 'worn' by a user virtually anywhere the user goes. Thus, in an embodiment, the IHS 200 is 'portable' or 'mobile' in that it is of a size such that a user may chose to be in virtual perpetual possession of the IHS 200, as is know in the art of mobile or portable phones. For example, the IHS 200 illustrated in FIG. 2 includes dimensions that allow the IHS to be carried in a pocket or bag that is in the users possession wherever the user goes, as is also known in the art. However, while the IHS 200 is illustrated as a mobile or portable phone, one of skill in the art will recognize that the disclosure is not so limited, and other mobile or portable IHSs such as, for example, laptop computers, netbook computers, tablet computers, and a variety of other mobile or portable devices may implement the system discussed below without departing from the scope of the present disclosure.

Figure 3:
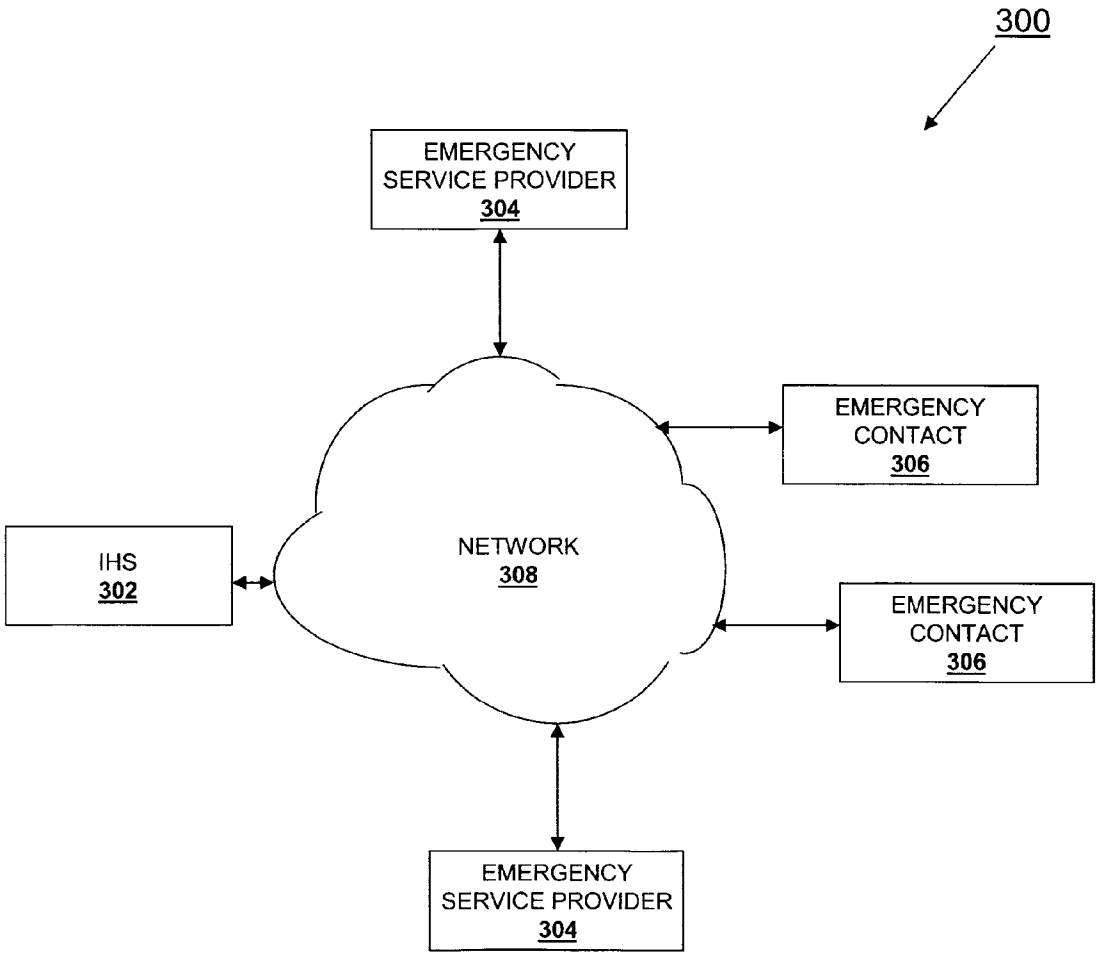
FIG. 3 is a schematic view illustrating an embodiment of an emergency service provider contact system.

Referring now to FIG. 3, an emergency service provider contact system 300 is illustrated. The system 300 includes an IHS 302, which may be the IHS 100 or the IHS 200, described above with reference to FIGS. 1 and 2. The IHS 302 is coupled to a plurality of emergency service providers 304 and a plurality of emergency contacts 306 through a network 308. In an embodiment, the IHS 302 is coupled to the network 308 through a communications module such as, for example, the communications module 116 discussed above. In an embodiment, the network 308 may include a phone network, an computer network (e.g., the Internet or an intranet), and/or a variety of other networks known in the art. In an embodiment, the emergency service providers 304 may include a police department, a fire department, an emergency medical service, a location-specific emergency response service, and/or a variety of other emergency services providers known in the art. In an embodiment, the emergency contacts 306 may be persons with whom a user of the IHS 302 may want contacted in case of an emergency such as, for example, a relative (e.g., spouse, parent, sibling, etc.), a friend, a co-worker, and/or a variety of other emergency contacts known in the art. Each of the emergency service providers 304 and the emergency contacts 306 may include one or more devices (phones, IHSs, etc.) connected to the network 308 such that they may communicate with the IHS 302 through the network 308.

Figure 4:
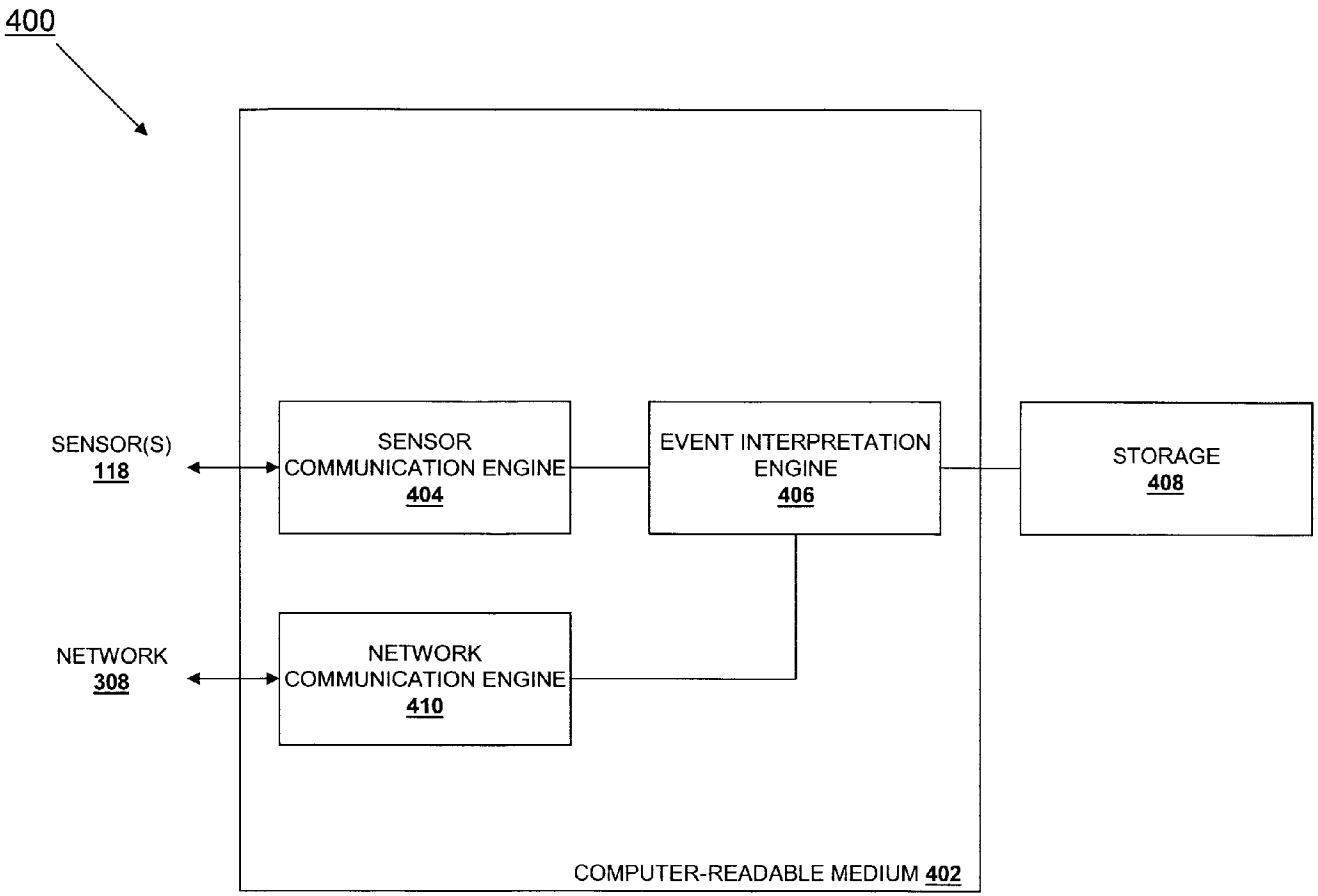
FIG. 4 is a schematic view illustrating an embodiment of an information handling system used in the emergency service provider contact system.
Figure 5:
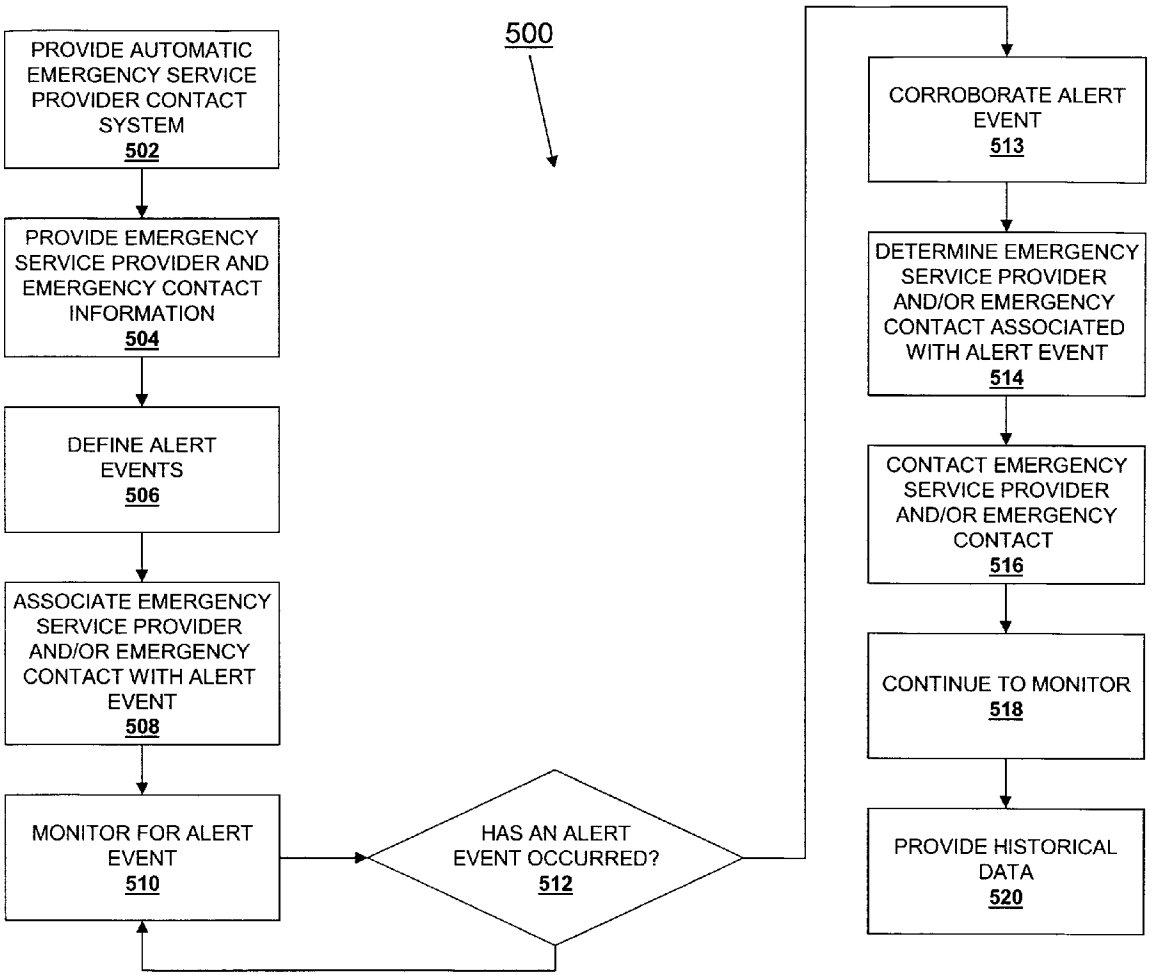
FIG. 5 is a flow chart illustrating an embodiment of a method for contacting an emergency service provider.

Referring now to FIG. 4, a portion of an IHS 400, which may be the IHS 100, 200, or 302 discussed above, is illustrated. The IHS 400 includes a non-transitory computer-readable medium 402 which may be, for example, the memory 114, the storage 108, and/or a variety of other computer-readable mediums known in the art. The computer-readable medium 402 includes a sensor communication engine 404 which may be software stored on the computer-readable medium 402 that, when executed by the processor 102, allows communication with the sensors 118 coupled to the IHS 400. The sensor communication engine 404 is coupled to an event interpretation engine 406 which may be software stored on the computer-readable medium 402 that, when executed by the processor 102, receives events detected by the sensors 118 from the sensor communication engine 404 and interprets those events, as described in further detail below. The event interpretation engine 406 is coupled to the storage 408 that may include information related to emergency service providers, emergency contacts, event interpretation, and a variety of other information known in the art. The event interpretation engine 406 is also coupled to a network communication engine 410 which may be software stored on the computer-readable medium 402 that, when executed by the processor 102, allows communication with other IHSs over the network 308.

Referring now to FIGS. 1, 2, 3, 4, and 5 a method 500 for contacting an emergency service provider is illustrated. The method 500 begins at block 502 where an automatic emergency service provider contact system is provided. In an embodiment, the automatic emergency service provider contact system 300 is provided including the IHS 100, 200, and/or 400 coupled to the network 308. The method 500 then proceeds to block 504 where emergency service provider information and emergency contact information is provided. In an embodiment, the IHS may prompt a user for emergency service provider information through, for example, the display 110, 206. The user may then provide emergency service provider information to the IHS that includes an emergency service provider (e.g., police department, a fire department, an emergency medical service, a location-specific emergency response service, etc.) and contact information for that emergency service provider (e.g., address, phone number, and/or a variety of other contact information known in the art), and that emergency service provider information may be stored in the storage 108. In an embodiment, the IHS may be able to use location sensors and map software to determine the locations and contact information for a plurality of emergency service providers that are within a predetermined distance of the IHS, and that emergency service provider information may be stored in the storage 108. In an embodiment, the IHS may prompt a user for emergency contact information through, for example, the display 110, 206. The user may then provide emergency contact information to the IHS that includes an emergency contact (e.g., the name of a relative, friend, co-worker, etc.) and contact information for that emergency contact (e.g., address, phone number, and/or a variety of other contact information known in the art), and that emergency contact information may be stored in the storage 108. In an embodiment, the IHS may search a storage (e.g., the storage 108) for emergency contact information and present the emergency contact information that is retrieved to the user for verification as appropriate emergency contacts.

The method 500 then proceeds to block 506 where one or more alert events are defined. In an embodiment, an alert event is reading from one of the sensors 118 that exceeds a threshold reading and may indicate that the IHS (and its corresponding user) require emergency services. In such an embodiment, the IHS may prompt for (e.g., using the display 110, 206), or have predefined, one or more alert events that includes one or more respective threshold readings for the sensors 118, and each alert event may be stored in the storage 108. For example, an alert event may be defined that includes a threshold reading of a 10 G force from an accelerometer (e.g., which may indicate a car accident.) In another example, an alert event may be defined that includes a threshold reading of a temperature exceeding 150 degrees Fahrenheit from a temperature sensor (e.g., which may indicate a fire.) In another example, an alert event may be defined that includes a threshold reading of a predetermined amount of a harmful chemical from a chemical sensor (e.g., which may indicate a chemical poisoning.) In another example, an alert event may be defined that includes a threshold reading of gunshot detected by a microphone within a predefined distance from the IHS. Furthermore, an alert event may be defined that includes a plurality of threshold readings on respective sensors 118. For example, an alert event may be defined that includes a threshold reading of a velocity of at least 35 miles per hour (e.g., from a GPS sensor), followed by a 10 G force from an accelerometer (e.g., which may indicate a car accident.) In another example, an alert event may be defined that includes a threshold reading of a temperature increase of 50 degrees Fahrenheit from a temperature sensor in a time period of less than 1 minute (e.g., which may indicate a fire.) In another example, an alert event may be defined that includes a threshold reading of a temperature below a predetermined level (e.g., 30 degrees Fahrenheit) from a temperature sensor for more than a predetermined time period (e.g., 2 hours, which may indicate hypothermic conditions) In another example, an alert event may be defined that includes a threshold reading of a loss of GPS awareness from a GPS sensor followed by a threshold reading of a temperature above or below a predetermined level (e.g., 120 degrees Fahrenheit or 30 degrees Fahrenheit—i.e., extreme heat or cold) from a temperature sensor in a predetermined time period (e.g., 1 minute—i.e., suddenly.) While a plurality of alert events have been described above, such description is not meant to be limiting, and one of skill in the art will recognize how accelerometers, global positioning system (GPS) modules or other location sensing technologies, magnetometers, gyros (single and multi-axis), temperature sensors, electromagnetic sensors, skin conductivity sensors, compasses, chemical sensors, Geiger counters, proximity sensors, noise sensors (e.g., microphones), pressure sensors, humidity sensors, allergen sensors, air pollution sensors, subsonic and ultrasonic field sensors, light sensors, and/or a variety of other sensors known in the art, may be used to create alert events relying on threshold readings from one or more of those sensors that may indicate that a user of the IHS needs emergency services.

The method 500 then proceeds to block 508 where an emergency service provider and/or an emergency contact are associated with each alert event. Each alert event may be associated with one or more emergency service providers, and that association may be stored in the storage 108. For example, an alert event that indicates a fire may be associated with a fire department, an alert event that indicates a car accident may be associated with an emergency medical service, an alert event that indicates a gunshot may be associated with a police department, an alert event that indicates a user of the IHS is lost in the wilderness may be associated with a location specific emergency response service such as a search and rescue service, etc. Furthermore, any alert event may be associated with more than one emergency service provider (e.g., the alert event that indicates a fire may be associate with the fire department and an emergency medical service, the alert event that indicates a gunshot may be associate with the police department and an emergency medical service, etc.) Each alert event may also, or separately, be associated with one or more emergency contacts, and that association may be stored in the storage 108. For example, any of the alert events discussed above may also be associated with a spouse, relative, co-worker, etc. In another example, an alert event that indicates a high stress level in a user of the IHS may be associated with a spouse, relative, co-worker, etc. While a plurality of alert events/emergency service provider and/or emergency contact associations have been described above, such description is not meant to be limiting, and one of skill in the art will recognize that a variety of other associations may be made without departing from the scope of the present disclosure.

The method 500 then proceeds to block 510 where the emergency service provider contact system monitors for an alert event. In an embodiment, the emergency service provider contact system is enabled such that the event interpretation engine 406 may use the sensor communication engine to monitor readings from the one or more sensors 118. In an embodiment, the emergency service provider contact system may be disabled at any time if, for example, the user of the IHS determines that any current conditions may unwantedly trigger an alert event. The method 500 then proceeds to decision block 512 where it is determined whether an alert event has occurred. In an embodiment, the event interpretation engine 406 may retrieve the alert events stored in the storage 108 and compare readings from the one or more sensors 108 with the threshold readings that define the alert events. If no reading or combination of readings from any one or combination of the sensors 108 exceeds the threshold reading or combinations of readings that define an alert event, the method 500 returns to block 510 where the emergency service provider contact system continues to monitor for an alert event.

If a reading or combination of readings from any one or combination of the sensors 108 exceeds the threshold reading or combinations of readings that define an alert event, the method 500 proceeds to block 514 where an emergency service provider and/or emergency contact are determined to be associated with the alert event. However, prior to contacting the emergency service provider and/or emergency contact, the event interpretation engine may do an algorithmic analysis of other sensor readings to reduce 'false positives', or the contacting of emergency service providers and/or emergency contacts when there is no emergency. In an embodiment, the event interpretation engine 406 may use the sensor communication engine 404 or stored sensor readings to determine at least one secondary event from one or more of the sensors 118 and use that secondary event to corroborate the alert event. For example, if an alert event indicates that a car accident has occurred due to detecting a traveling velocity of 50 miles per hour followed by a 10 G force, the event interpretation engine 406 may determine whether the stored sensor readings in the storage include a sound recording having a decibel level high enough to indicate a car collision. If the secondary event does not corroborate the alert event (i.e., there is no sound recording having the proper decibel level), the emergency service provider and/or emergency contact associated with that alert event are not contacted. However, if the secondary event corroborates the alert event (i.e., there is a sound recording having the proper decibel level), the emergency service provider and/or emergency contact are contacted. In an embodiment, the emergency service provider contact system may warn the user (e.g., using the display, an audio alert from the IHS, and/or a variety of other methods known in the art) that an emergency service provider and/or emergency contact is about to be contacted.

The event interpretation engine 406 may use the alert event determined to have occurred in decision block 512 to search the storage 108 for any emergency service providers and/or emergency contacts associated with that alert event and retrieve the emergency service provider information and/or emergency contact information for the associated emergency service providers and/or emergency contacts. The method 500 then proceeds to block 516 where one or more emergency service providers and/or emergency contacts are contacted. The event interpretation engine 406 uses the emergency service provider information and/or emergency contact information retrieved in block 514 in the method 500 and the network communication engine 410 to contact the emergency service providers and/or emergency contacts associated with the alert event determined to have occurred in decision block 512. In an embodiment, the emergency service providers and/or emergency contacts may be contacted through network communication engine 410 over the network 308 using methods known in the art (e.g., voice message using a phone number, text message using a phone number, email message using an email address, etc.) The message provided to the emergency service providers and/or emergency contacts may be a generic message (e.g., "user requests emergency services") and may use location sensors to provide directions to the emergency service providers and/or emergency contacts (e.g., "user requests emergency services at 1234 Congress Avenue, Austin Tex. 78701"). Furthermore, the message provided to the emergency service providers and/or emergency contacts may include specifics from the sensor readings that resulted in the alert event (e.g., "user requests emergency services for a likely car accident detected due to a traveling velocity of 50 miles per hour followed by a 10 G force", or "user requests emergency services for possible hypothermia detected due to an exposure to a temperature of 5 degrees Fahrenheit for over 2 hours". In an embodiment, the message provided to the emergency service providers and/or emergency contacts may include contact information for the user (e.g., a phone number.) In an embodiment, the emergency services provider contact system may request confirmation that emergency service provider and/or emergency contact are going to respond to the request for emergency service. In an embodiment, the emergency services provider contact system may contact the emergency service provider and/or emergency contact associated with the alert event determined to have occurred at decision block 512 periodically (e.g., every 20 minutes.)

The method then proceeds to block 518 where the emergency services provider contact system continues to monitor using the sensors 118. The event interpretation engine 406 may use the sensor communication engine 404 to use the one or more sensors to monitor and record all information being detected by the sensors 118. In an embodiment, information detected by the sensors before, during, and/or after the alert event is monitored, recorded, and saved in the storage 408. The method 520 then proceeds to block 520 where historical data is provided. In an embodiment, the IHS may be used by the emergency service provider(s) and/or the emergency contact(s) to retrieve any information detected by the sensors 118 and stored in the storage to help diagnose the users situation. Thus, an emergency service provider contact system is provided that allows an emergency service provider and/or emergency contact to be automatically contacted in the event a user of the system experiences an emergency that may not allow the user to contact help themselves.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An emergency service provider contact system, comprising:

a processor;

a storage coupled to the processor;

at least one sensor coupled to the processor; and a non-transitory, computer-readable medium coupled to the processor, wherein the non-transitory, computer-readable medium includes instructions that, when executed by the processor, cause the processor to:

detect an alert event through the at least one sensor, wherein the alert event includes a first reading from the at least one sensor that exceeds a first threshold reading;

retrieve at least one secondary event detected by the at least one sensor in response to detecting the alert event that includes the first reading that exceeds the first threshold reading, wherein the at least one secondary event is contemporaneous with the alert event and includes a second reading from the at least one sensor that exceeds a second threshold reading;

determine that the at least one secondary event corroborates the alert event without input from a user;

determine that at least one emergency service provider is associated with the alert event in the storage, wherein the at least one emergency service provider includes contact information; and contact the emergency service provider using the contact information.

2. The system of claim 1, further comprising:

at least one threshold reading in the storage associated with each at least one sensor.

3. The system of claim 2, wherein the non-transitory, computer-readable medium includes instructions that, when executed by the processor, cause the processor to:

prompt for the at least one threshold reading for a sensor;

receive the at least one threshold reading; and store the at least one threshold reading in the storage.

4. The system of claim 1, wherein the non-transitory, computer-readable medium includes instructions that, when executed by the processor, cause the processor to:

prompt for the at least one emergency services provider and associated alert event; and receive the at least one emergency services provider and associated alert event;

store the at least one emergency services provider and associated alert event in the storage.

5. The system of claim 1, wherein the non-transitory, computer-readable medium includes instructions that, when executed by the processor, cause the processor to:

provide a warning to a user that the emergency service provider is being contacted.

6. The system of claim 1, wherein the at least one sensor includes an accelerometer, and wherein the detecting the alert event includes detecting an acceleration reading from the accelerometer that exceeds the first threshold reading.

7. The system of claim 1, wherein the at least one sensor includes a global positioning system (GPS), and wherein the detecting the alert event includes analyzing a plurality of GPS readings.

8. The system of claim 1, wherein the at least one sensor includes a temperature sensor, and wherein the detecting the alert event includes detecting a temperature reading from the temperature sensor that deviates from the first threshold reading.

9. An information handling system, comprising:

a portable chassis;

a processor housed in the portable chassis;

a storage housed in the portable chassis and coupled to the processor;

a communications module housed in the portable chassis and coupled to the processor;

at least one sensor housed in the portable chassis and coupled to the processor;

a display housed in the portable chassis and coupled to the processor; and a non-transitory, computer-readable medium housed in the portable chassis and coupled to the processor, wherein the non-transitory, computer-readable medium includes instructions that, when executed by the processor, cause the processor to:

monitor the at least one sensor; and in response to detecting an alert event through the at least one sensor that includes a first reading from the at least one sensor that exceeds a first threshold reading;

retrieve at least one secondary event, which was detected through the at least one sensor, that was contemporaneous with the alert event, and includes a second reading from the at least one sensor that exceeds a second threshold reading, corroborates the alert event without input from a user;

search the storage using the alert event to retrieve contact information for at least one emergency service provider that is associated with the alert event; and contact the emergency service provider through the communications module using the contact information.

10. The system of claim 9, further comprising:

at least one threshold reading in the storage associated with each at least one sensor.

11. The system of claim 10, wherein the non-transitory, computer-readable medium includes instructions that, when executed by the processor, cause the processor to:

prompt for the at least one threshold reading for a sensor using the display;

receive the at least one threshold reading; and store the at least one threshold reading in the storage.

12. The system of claim 9, wherein the non-transitory, computer-readable medium includes instructions that, when executed by the processor, cause the processor to:

prompt for the at least one emergency services provider and associated alert event using the display;

receive the at least one emergency services provider and associated alert event; and store the at least one emergency services provider and associated alert event in the storage.

13. The system of claim 9, wherein the non-transitory, computer-readable medium includes instructions that, when executed by the processor, cause the processor to:

provide a warning to a user that the emergency service provider is being contacted.

14. The system of claim 9, wherein the at least one sensor includes an accelerometer, and wherein the detecting the alert event includes detecting an acceleration reading from the accelerometer that exceeds the first threshold reading.

15. The system of claim 9, wherein the at least one sensor includes a global positioning system (GPS), and wherein the detecting the alert event includes analyzing a plurality of GPS readings.

16. The system of claim 9, wherein the at least one sensor includes a temperature sensor, and wherein the detecting the alert event includes detecting a temperature reading from the temperature sensor that deviates from the first threshold reading.

17. A method for contacting an emergency service provider, comprising:

monitoring at least one sensor;

detecting an alert event through the at least one sensor that includes a first reading from the at least one sensor that exceeds a first threshold reading;

retrieving at least one secondary event detected by the at least one sensor in response to detecting the alert event that includes the first reading that exceeds the first threshold reading, wherein the at least one secondary event is contemporaneous with the alert event and includes a second reading from the at least one sensor that exceeds a second threshold reading;

determining that the at least one secondary event corroborates the alert event without input from a user;

determining that at least one emergency service provider is associated with the alert event in a storage, wherein the at least one emergency service provider includes contact information; and contacting the emergency service provider using the contact information.

18. The method of claim 17, further comprising:

at least one threshold reading associated with each at least one sensor.

19. The method of claim 18, further comprising:

prompting for the at least one threshold reading for a sensor;

receiving the at least one threshold reading; and storing the at least one threshold reading in the storage.

20. The method of claim 17, further comprising:

providing a warning that the emergency service provider is being contacted.

* * * * *